United States Patent [19]

Brzozowski

[11] Patent Number: 4,566,294

[45] Date of Patent: Jan. 28, 1986

[54] METHOD FOR THE MOUNTING OF GEMS AND RESULTING PRODUCT

[76] Inventor: Jan Brzozowski, 150 E. 69th St., New York, N.Y. 10021

[21] Appl. No.: 576,214

[22] Filed: Feb. 2, 1984

[51] Int. Cl.[4] ..... A44C 9/0; A44C 17/02

[52] U.S. Cl. ..... 63/15; 29/10; 29/160.6; 63/28

[58] Field of Search ..... 63/26, 27, 28, 15; 29/10, 160.6, 424

[56] References Cited

U.S. PATENT DOCUMENTS

| | | | |
|---|---|---|---|
| 529,611 | 11/1894 | Dittmer | 63/26 X |
| 1,534,442 | 4/1925 | Donahue | 63/28 |
| 1,539,940 | 6/1925 | Gaschke | 63/15 X |
| 1,854,958 | 4/1932 | Santosuosso | 63/28 |
| 1,863,617 | 6/1932 | Brogan | 63/26 X |
| 1,982,932 | 12/1934 | Scribner | 29/424 X |
| 2,749,597 | 6/1956 | Fus | 29/10 |

FOREIGN PATENT DOCUMENTS

| | | | |
|---|---|---|---|
| 1012785 | 6/1977 | Canada | 63/26 |
| 2428990 | 2/1980 | France | 29/10 |

*Primary Examiner*—F. Barry Shay

*Attorney, Agent, or Firm*—Roberts, Spiecens & Cohen

[57] ABSTRACT

A method for the mounting of diamonds in a ring by forming an annular groove in the ring having a V-shaped base. The groove is bordered by two upstanding rims and diamonds are placed in the groove in a row in abutting relationship and temporarily held there by wax. The rims are overturned on the peripheries of the diamonds to clamp the diamonds in the groove. The angle of the culettes of the diamonds is greater than the angle of the V-shaped base and the girdle of each diamond is forced downwardly into the groove at least to the outer extremities of the V-shaped base. The product is an annular ring of diamonds secured in a groove but spaced from the base thereof and held in position by turned in rims straddling the groove.

15 Claims, 8 Drawing Figures

METHOD FOR THE MOUNTING OF GEMS AND RESULTING PRODUCT

FIELD OF INVENTION

This invention relates to methods for the mounting of gems. The invention also relates to rings and other such products incorporating gems such as diamonds or the like mounted therein.

BACKGROUND

In researching my invention to determine the novelty thereof, I have become aware of the following U.S. Pat. Nos.: 795,109; 843,006; 860,204; 881,065; 899,516; and 1,328,949.

The Dover U.S. Pat. No. 795,109 reveals the mounting of a diamond in a triangular opening provided with upstanding rims. The Dover U.S. Pat. No. 843,006 illustrates that diamonds may be accommodated in separate conical openings. These arrangements fail to reveal the advantageous and unique mounting as will be disclosed in detail hereinbelow.

In the Fishel U.S. Pat. No. 860,204, is shown the mounting of diamonds in separate and respective sockets with the sockets being spaced from one another. The Fishel U.S. Pat. No. 881,165 also shows separate sockets being utilized with each socket being of conical form. These two patents likewise fail to reveal the advantageous mounting which will be described below.

The mounting which appears in the Dover U.S. Pat. No. 899,516 similarly shows separate accommodations for respective diamonds and this also is different from the mounting to be revealed hereinafter.

G. Dover shows in U.S. Pat. No. 1,328,949 another jewlery setting in the form of a bezel in which are provided a series of depressions some of which are in the form of a cone and some of which are in the form of a flat bottomed depression for a half pearl. These two types of depressions are in alternate positions. No continuous formation is provided as will be described below relative to the instant invention.

SUMMARY OF INVENTION

It is an object of the invention to provide an improved mounting for gems such as diamonds and the like.

It is a further object of the invention to provide an improved mounting for diamonds wherein the diamonds appear to be arranged in a continuous row and in abutting relationship.

It is a further object of the invention to provide an improved method for the mounting of gems, which method is susceptible of being easily performed in relatively short periods of time with an effective and economical use of labor.

Another object of the invention is to provide an improved mounting affording a unique appearance to an arrangement of a plurality of gems or stones.

In achieving the above and other objects of the invention, there is provided a method for the mounting of gems which comprises forming a groove in a metallic support with rims upstanding on opposite sides of the groove, arranging the gems in a row in this groove, and deforming the rims to overlap the gems peripherally in the groove. In the method of the invention, the gems will have apices and are arranged with the apices spaced from the bottom of the groove. Moreover, the gems will have girdles and the groove is formed with a generally symmetrical and V-shaped base against which the girdles are forced. Still further, and as will be described in greater detail hereinbelow, the gems will be characterized by pavilions of generally similar angles and the V-shaped base is formed with a smaller angle, the rims being spaced apart at a distance which is at least as great as the size of the gems at the girdles thereof.

According to a more specific feature of the invention, the angle of the base is formed to be about 10–20% less than the angle of the pavilions as mentioned hereinabove. Preferably, the angle of the base is in the order of magnitude of about 15% less than the angle of the pavilions. In a specific and preferred embodiment of the invention, the angle of the base is about 85 degrees and the angle of the pavilions is about 98 degrees.

These angles and angle ranges permit penetration of the gems an adequate amount into the base while maintaining a spacing between the apices of the gems relative to the bottom of the base to an extent which enables use of an adequate amount of wax or other such deformable material as referred to hereinafter. The relative angles also permit a limited penetration of the girdles into the V-shaped base so as to maintain the crowns of the gems at substantially the same height.

In accordance with another specific feature of the invention, a deformable material such as wax is employed to line the base and the gems are forced into this deformable material or wax. Where wax is employed as the deformable material, it is melted and removed after the rims are deformed or turned over the stones.

According to another specific feature of the invention, the rims are simultaneously turned in towards each other and the support is formed as a ring of precious metal.

In accordance with one embodiment of the invention, the gems may have axes which are arranged radially with respect to the ring. According to another embodiment of the invention, the axes of the gems may be arranged in parallel to the axis of the ring.

The product of the invention may generally and by way of example be a toroidal body of precious metal provided with a peripheral annular groove having a symmetrical V-shaped base with gems, such as diamonds, including pavilions being mounted in the groove with the pavilions extending towards the base but being spaced therefrom. Rims on the body, as mentioned above, on opposite sides of the groove are provided which clamp the gems in the groove. As also indicated above, the gems are positioned in a row in at least substantially abutting relationship.

The above and other objects, features and advantages of the invention will be found in the detailed description which follows hereinafter as illustrated in the accompanying drawing.

DETAILED DESCRIPTION

There are various ways for installing diamonds or other types of gems or stones in an annular array with the axes thereof defining radii with respect to the ring mounting in which the diamonds are installed. Similarly, there are a variety of techniques for mounting stones or gems in an annular ring with the axes of the stone being arranged in parallel with the axis of the associated ring mounting.

Figure 1:
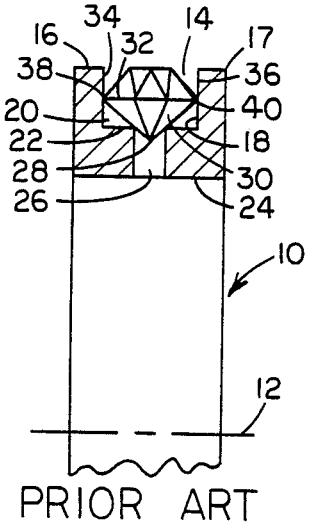
FIG. 1 is a fragmentary view of a ring prior to the installation of gems therein and partly in cross-section illustrating a groove arrangement which has been previously employed.

One such technique is illustrated in FIG. 1 wherein a ring body or mounting 10 having an axis 12 is provided with a peripheral annular groove indicated at 14 and straddled or bordered by two upstanding rims 16 and 17. In this illustration, the groove 14 is provided with two right angled corners 18 and 20 defining a base 22 having an inner wall 24 and provided with a plurality of radially disposed openings or bores 26. These bores are circumferentially spaced at regular distances in the groove 14 and are each intended to accommodate the apex 28 and lowermost portion of the culette 30 of the associated stone. The girdle of the stone, as indicated at 32, contacts the side walls 34 and 36 of groove 14 at the points indicated at 38 and 40. Thereafter, the relatively soft and deformable metal of the ring body 10 permits the turning over or toeing in of the rims 16 and 17 such that each stone or gem is fixed in position with its apex 28 extending into the associated opening 26. This technique has certain draw backs as it requires the careful positioning of the openings or bores 26 and similarly requires the use of identically sized stones or gems failing which there will be gaps or spaces between adjacent stones when the ring is complete.

Figure 2:
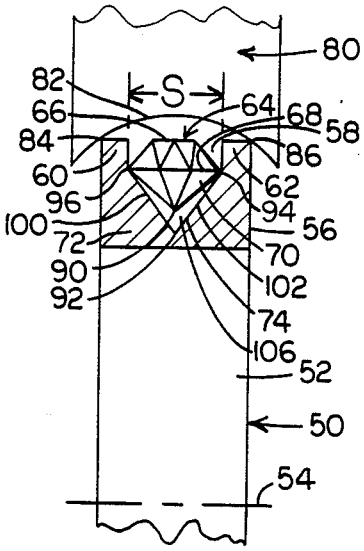
FIG. 2 is a view corresponding to FIG. 1 illustrating a setting of the invention including a gem in process of being installed by a tool which is shown in fragmentary view.

FIG. 2 illustrates the initial phase of the mounting of gems or stones such as diamonds in accordance with the invention. More particularly, in the illustrated embodiment, there is provided a ring body or mounting 50 having a central bore or finger opening 52 and defining an axis 54, the ring consisting of an annular or toroidal body 56 of a precious metal such as gold, silver, platinum or the like. The ring is provided with an annular peripherally located groove 58 bordered by two upstanding rims 60 and 62 and accommodating, in the groove, a row of diamonds or other such gems such as indicated at 64. As is conventional, the type of diamonds employed includes a crown 66, a girdle 68, a pavilion 70 and an apex 90.

As distinguished from the type of groove shown in FIG. 1, the groove 58, which is formed in body 72, is provided with a base 74 which is symmetrical and V-shaped. The groove is of substantially uniform cross-section and is a continuous annular ring extending preferably completely around the entire periphery of the ring 50 although shorter extensions are contemplated to be within scope of the invention.

Figure 4:
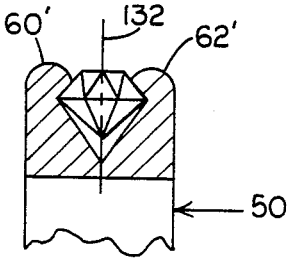
FIG. 4 is a view similar to FIGS. 1 and 2 illustrating a setting or mounting with a diamond clamped therein.

In FIG. 2 is illustrated a turning tool 80. It is in the form of a wheel having a periphery 82 which is of concave shape and opens radially outward from the axis of this tool. It is of a size which permits the engagement of rims 60 and 62 at 84 and 86. The application of the ring to the face 82 permits the toeing in of the rims to occupy the confining position indicated at 60' and 62' in FIG. 4. This toeing in operates to clamp the stones in position within the groove 58 thereby to form a row of diamonds, the peripheries of which are in abutting relationship as will be discussed hereinbelow with respect to FIG. 5. Before an examination of FIG. 5 ensues, however, it is to be noted that the apex 90 of each stone is spaced from the bottom or apex 92 of the V-shaped base 74. It will also be noted that the girdle is installed and urged downwardly so that contact is made, for example, at points 94 and 96 according to the relative size of the groove and base as compared with the outer diameter of the stone 64 at the girdle 68. To accommodate the preferred location of each stone 64, the spacing of the rims 60 and 62 is as indicated at S greater than the outer diameter of the gem 64 at the girdle. The girdle 68 will thus pass by the rims 60 and 62 and particularly the inner walls thereof and will encounter the walls 100 and 102 of the base 74. At some point, the insertion of the stone 64 will be halted by the encounter of the girdle of the stone with the base and this will define the furthest penetration of the stone into the ring or mounting 50.

According to a further feature of the invention, the space 106 defined between the stone and the base 74 is filled with a deformable substance W such as wax. This wax (See FIG. 3) is actually inserted before the insertion of the stone to form a bed or cushion on the base 74. It receives the penetration of the stone 64 which is thereby temporarily held firmly in position. A plurality of stones may be inserted into position. Indeed, the entire groove 58 may be filled with stones as desired before the turning in of the rims 60 and 62 is effected by use of the tool 80. After the rims 60 and 62 have been turned into the positions indicated at 60' and 62', the wax may be melted and removed through the interstices between the stones which are located in their final position.

Figure 3:
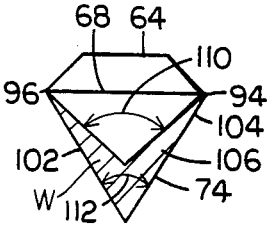
FIG. 3 is a diagrammatic view illustrating the angular relationships of a diamond and groove employed in accordance with the invention.

In FIG. 3 is diagrammatically illustrated the relationship between the stone 64 and the base 74. More particularly, it can be seen that the stone 64 has an angle in its pavilion portion indicated at 110 whereas the base 64 with its V-shape defines an angle 112. The angle 112 is, in accordance with the invention, less than the angle 110. More particularly, the angle 112 is preferably 10–20% less in magnitude than the angle of the pavilion of the illustrated stone. Even more specifically, the angle of the base is in the order of magnitude of about 15% less than the angle of the pavilion. This enables the stone to be most appropriately positioned and forced into the wax which has been previously installed in the position indicated at 106. FIG. 3 furthermore shows the encounter of the girdle 68 at points 94 and 96 with the side walls 102 and 104 of the V-shaped base 74.

Figure 5:
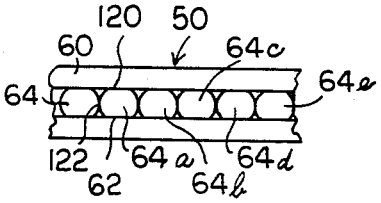
FIG. 5 is a fragmentary view converted to planar view of a row of diamonds installed in accordance with the invention.

In FIG. 5 is illustrated the ring body or mounting 50 with rim 60 and 62. The rims overlap the stones as indicated at 120. In FIG. 5, a plurality of stones 64, **64*a*, 64*b*, 64*c*, 64*d*, 64*e* etc. are illustrated. These stones are held in abutting relationship at points 122**.

Figure 6:
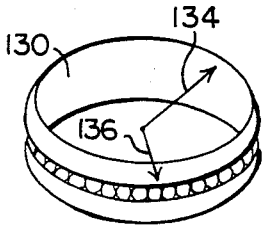
FIG. 6 is a perspective view of a ring provided in accordance with the invention.
Figure 7:
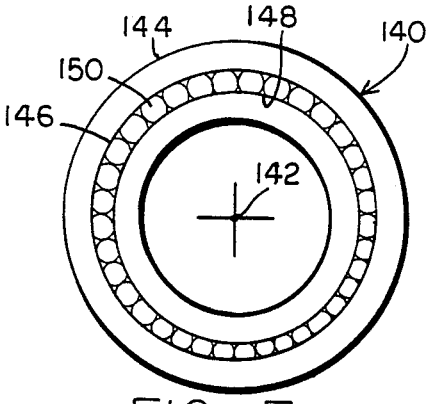
FIG. 7 is a top plan view of a second product of the invention with stones being mounted in an annular groove.

Rows of stones may be arranged in accordance with the invention in a ring as shown in perspective at 130 in FIG. 6 or in a bezel as shown, for example, at 140 in FIG. 7. In FIG. 6, the stones are shown with their axes 132 (see also FIG. 4) disposed along radii such as indicated at 134 and 136. In the bezel 140 illustrated in FIG. 7, the stones are positioned with the axes thereof mounted in parallel with the axes 142 of the bezel body 144. Therein annular rims 146 and 148 are installed and toed in in a manner comparable to that illustrated in FIG. 4. The stones 150 in the embodiment of FIG. 7 are mounted in an annular closed end array and in abutting relationship in the same manner as has been generally described hereinabove.

Figure 8:
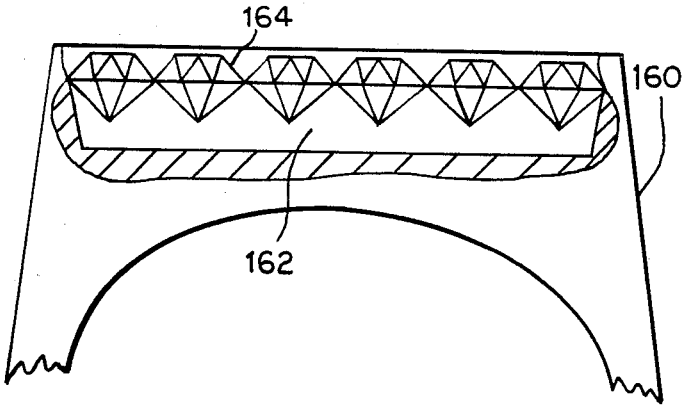
FIG. 8 is a fragmentary side view partially broken away, showing a ring with a linear array of stones.

FIG. 8 shows a ring 160 having a V-shaped continuous channel 162 of rectilinear form with diamonds or stones 164 therein as in FIGS. 3 and 5.

There will now be obvious to those skilled in the art, many modifications and variations of the structures and methods which have been set forth hereinabove. These modifications and variations will not depart from the scope of the invention if lying within the scope of the following claims or if functionally equivalent thereto.

What is claimed is:

1. A method for the mounting of gems, said method comprising forming a groove in a metallic support with rims upstanding on opposite sides of the groove, arranging the gems in a row in said groove, and deforming the rims to peripherally overlap the gems in the groove, the gems having apices, said apices being spaced above the bottom of the groove, the gems having girdles, the girdles of adjacent gems in said row abutting each other, the groove being formed with a symmetrical generally V-shaped base against which the girdles are forced during the deforming step, the gems having pavilions of generally similar angles and the V-shaped base being formed with a smaller angle, the rims prior to the deforming step being spaced apart at a distance which is at least as great as the size of the gems at the girdles thereof.

2. A method as claimed in claim 1 wherein the angle of the base is formed to be about 10–20% less than the angle of the pavilions.

3. A method as claimed in claim 2 wherein the angle of the base is the order of magnitude of about 15% less than the angle of the pavilions.

4. A method as claimed in claim 3 wherein the angle of the base is about 85 degrees and the angle of the pavilions is about 98 degrees.

5. A method as claimed in claim 1 wherein a deformable material is employed to line the base and the gems are forced into the deformable material.

6. A method as claimed in claim 5 wherein the deformable material is wax.

7. A method as claimed in claim 5 wherein the deformable material is removed after the rims are deformed.

8. A method as claimed in claim 6 wherein the wax is melted and removed after the rims are deformed.

9. A method as claimed in claim 1 wherein the rims are simultaneously turned in towards each other.

10. A method as claimed in claim 1 wherein said support is formed as a ring of precious metal.

11. A method as claimed in claim 10 wherein the gems have axes which are arranged radially with respect to said ring.

12. A method as claimed in claim 10 wherein the gems have axes which are arranged in parallel to the axis of the ring.

13. A ring manufactured according to the method of claim 11.

14. A ring manufactured according to the method of claim 12.

15. A ring comprising a toroidal body of precious metal provided with a peripheral annular groove of substantially uniform cross-section having a symmetrical V-shaped base, gems, all of said gems including girdles and pavilions of substantially similar angles, said gems being mounted in said groove with the pavilions extending towards said base, the gems having apices spaced above the bottom of said base, the base being of an angle smaller than that of said pavilions, the girdles resting against said base, and rims on said body on opposite sides of said groove and clamping the gems in said groove, the gems being positioned adjacent to one another in a row with said girdles of adjacent gems in abutting relationship.

* * * * *

US004566294B1

REEXAMINATION CERTIFICATE (2352nd)

United States Patent [19]

Brzozowski

[11] B1 4,566,294

[45] Certificate Issued Aug. 9, 1994

[54] METHOD FOR THE MOUNTING OF GEMS AND RESULTING PRODUCT

[76] Inventor: Jan Brzozowski, 150 E. 69th St., New York, N.Y. 10021

Reexamination Request:
No. 90/003,262, Nov. 23, 1993

Reexamination Certificate for:

| | |
|---|---|
| Patent No.: | **4,566,294** |
| Issued: | **Jan. 28, 1986** |
| Appl. No.: | **576,214** |
| Filed: | **Feb. 2, 1984** |

[51] Int. Cl.[5] ..... A44C 9/00; A44C 17/02

[52] U.S. Cl. ..... 63/15; 63/28; 29/10; 29/160.6

[58] Field of Search ..... 63/15, 26–31; 29/10, 160.6, 424

[56] References Cited

U.S. PATENT DOCUMENTS 1,534,442 4/1925 Donahue .
1,854,958 4/1932 Santosuosso .
1,863,617 6/1932 Brogan .

FOREIGN PATENT DOCUMENTS 2428990 1/1980 France .

OTHER PUBLICATIONS

Creative Jewelry Making—Techniques for Craftsmen, by L. Hemard, 1975, p. 70.
Jewelry Concepts and Technology, by O. Untracht, 1982, pp. 629, 630, 631 and 632.
The Jewelry Repair Manual, by R. A. Hardy, 1967 in cloth and 1982 in paperback, pp. 204–206.
Advanced, by Advanced Ring Manufacturers, Inc., 1970, p. 11; and Advanced II, 1976, plate 14 and plate 20.
Adwar Casting Co., Ltd.—Your Guide to Fine and Artistic Castings, by Adwar, Jan. 1, 1982, p. 303; and Declaration by Keith Adwar.
G&W Castings, by G&W Castings, Inc., p. R52, pre-1982; and Declaration by Philip Perlmutter.
M. Fabricant & Sons—A Thing of Beauty is a Joy Forever 1982–1983, pp. 8F and 30F.
Jewelry Making—for Schools. Tradesmen. Craftsmen, by M. Bovin, revised by P. Bovin, 1967 revised in 1970, pp. 5, 173, 174, 198 and 199.
Creative Casting, Jewelry, Silverware, Sculpture, by S. Choate, 1966, pp. 90, 91, 112 and 113.
Karbra, by Karbra Co., Inc., 1978, pp. 280 and 301.
Metal Jewelry Techniques, by M. Chamberlain, 1976, p. 140.

*Primary Examiner*—Flemming Saether

[57] ABSTRACT

A method for the mounting of diamonds in a ring by forming an annular groove in the ring having a V-shaped base. The groove is bordered by two upstanding rims and diamonds are placed in the groove in a row in abutting relationship and temporarily held there by wax. The rims are overturned on the peripheries of the diamonds to clamp the diamonds in the groove. The angle of the culettes of the diamonds is greater than the angle of the V-shaped base and the girdle of each diamond is forced downwardly into the groove at least to the outer extremities of the V-shaped base. The product is an annular ring of diamonds secured in a groove but spaced from the base thereof and held in position by turned in rims straddling the groove.

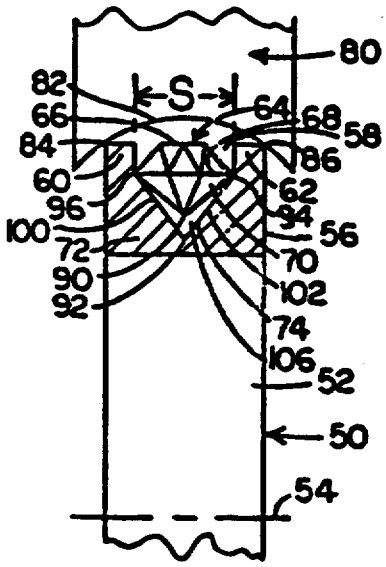

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-15 is confirmed.

* * * * *